US005820450A

United States Patent [19]

Calhoun

[11] Patent Number: 5,820,450

[45] Date of Patent: Oct. 13, 1998

[54] ABRASIVE ARTICLE HAVING PRECISE LATERAL SPACING BETWEEN ABRASIVE COMPOSITE MEMBERS

[75] Inventor: Clyde D. Calhoun, Stillwater, Minn.

[73] Assignee: Minnesota Mining & Manufacturing Company, St. Paul, Minn.

[21] Appl. No.: 857,672

[22] Filed: May 19, 1997

Related U.S. Application Data

[60] Continuation of Ser. No. 419,806, Apr. 11, 1995, abandoned, which is a division of Ser. No. 820,155, Jan. 13, 1992, Pat. No. 5,437,754.

[51] Int. Cl.[6] ..... B24D 15/04

[52] U.S. Cl. ..... 451/530; 451/526; 451/527

[58] Field of Search ..... 451/526, 530, 451/528, 527, 534

[56] References Cited

U.S. PATENT DOCUMENTS

| | | | |
|---|---|---|---|
| Re. 29,808 | 10/1978 | Wagner | 51/401 |
| 794,495 | 7/1905 | Gorton . | |
| 1,611,218 | 12/1926 | Mell | 264/139 |
| 1,657,784 | 1/1928 | Bergstrom . | |

(List continued on next page.)

FOREIGN PATENT DOCUMENTS

| | | |
|---|---|---|
| 2009718 | 8/1990 | Canada . |
| 0004454 | 10/1979 | European Pat. Off. . |
| 109851 B1 | 5/1984 | European Pat. Off. . |
| 168065 A1 | 1/1986 | European Pat. Off. . |
| 345239 A1 | 12/1989 | European Pat. Off. . |
| 0429269 | 5/1991 | European Pat. Off. . |
| 0 434 378 | 6/1991 | European Pat. Off. . |
| 554668 A1 | 8/1993 | European Pat. Off. . |
| 650803 A1 | 5/1995 | European Pat. Off. . |
| 650807 A1 | 5/1995 | European Pat. Off. . |
| 881239 | 4/1943 | France . |
| WO 92/15626 | 9/1992 | WIPO . |
| WO 93/12911 | 7/1993 | WIPO . |
| WO 93/13912 | 7/1993 | WIPO . |
| WO 94/20264 | 9/1994 | WIPO . |
| WO 94/27780 | 12/1994 | WIPO . |

(List continued on next page.)

OTHER PUBLICATIONS

H. C. Park, "Films, Manufacture", Encyclopedia of Polymer Science and Engineering, Second Edition, vol. 7, p. 105 (1987).

Kirk–Othmer *Encyclopedia of Chemical Technology*, vol. 1, pp. 35–37 (1978).

"Irgacure® 369" Brochure of Ciba–Geigy Corp., 1993.

*Encyclopedia of Polymer Science and Technology*, vol. 8; John Wiley: New York; pp. 661–665 (1968).

J.V. Crivello, "Photoinitiated Cationic Polymerization", *Ann. Rev. mater. Sci.*, 13, 173–190 (1983).

K.L. Wilke et al., "Coated Abrasive Superfinishing: Predictable, Repeatable Texturing of Metal Roll Surfaces", from 3M Industrial Abrasives Division, Doc. No. A–ARLSF(92.05)BPH, May 1992 (8 pages).

"GEM Centerless Microfinishers", Brochure of Grinding Equipment & Machinery Co., Inc., Youngstown, OH (published before Jan. 1, 1990).

"Superfinishing: The Microfinishing Systems Way", Brochure of 3M Microfinishing Systems, 6 pgs (Jul. 14, 1988).

V.A. Morozov, "How the Surface Relief of Abrasive Belts Affects Efficiency in Grinding Jobs", *Soviet Engineering Research*, 9, 103–107 (1989).

*Primary Examiner*—Eileen P. Morgan
*Attorney, Agent, or Firm*—Paul W. Busse

[57] ABSTRACT

The present invention provides a method of forming an abrasive article comprising the steps of providing an embossed carrier web having a plurality of recesses formed in the front surface thereof; filling the recesses with an abrasive composite slurry that includes a plurality of abrasive grains dispersed in a hardenable binder precursor, hardening the binder precursor to form individual abrasive composite members, laminating a backing sheet to the front surface of the embossed carrier web. The resulting article includes a plurality of precisely spaced abrasive composite members, positioned in a predetermined pattern and orientation on a backing sheet.

22 Claims, 3 Drawing Sheets

U.S. PATENT DOCUMENTS

| | | | |
|---|---|---|---|
| 1,941,962 | 1/1934 | Tone | 91/67.9 |
| 1,988,065 | 1/1935 | Wooddell | 91/68 |
| 2,001,911 | 5/1935 | Wooddell et al. | 51/190 |
| 2,015,658 | 10/1935 | Bezzenberger | 51/278 |
| 2,108,645 | 2/1938 | Bryant | 91/68 |
| 2,115,897 | 5/1938 | Woddell et al. | 51/188 |
| 2,252,683 | 8/1941 | Albertson | 51/293 |
| 2,292,261 | 8/1942 | Albertson | 51/295 |
| 2,410,506 | 11/1946 | Kirchner et al. | 51/188 |
| 2,567,186 | 9/1951 | Cross | 156/238 |
| 2,755,607 | 7/1956 | Haywood | 51/185 |
| 2,806,772 | 9/1957 | Robie | 51/296 |
| 2,876,086 | 3/1959 | Raymond | 51/298 |
| 2,907,146 | 10/1959 | Dyar | 51/195 |
| 2,984,052 | 5/1961 | Mueller | 51/188 |
| 3,048,482 | 8/1962 | Hurst | 51/298 |
| 3,057,256 | 10/1962 | Erban | 88/28.93 |
| 3,116,574 | 1/1964 | Ciesielski | 51/185 |
| 3,121,298 | 2/1964 | Mellon | 51/195 |
| 3,211,634 | 10/1965 | Lorenzo | 204/16 |
| 3,246,430 | 4/1966 | Hurst | 51/402 |
| 3,517,466 | 6/1970 | Bouvier | 51/358 |
| 3,539,426 | 11/1970 | Nakai | 156/231 |
| 3,549,341 | 12/1970 | Kittredge et al. | 51/293 |
| 3,594,865 | 7/1971 | Erb | 18/5 |
| 3,605,349 | 9/1971 | Anthon | 51/402 |
| 3,615,302 | 10/1971 | Rowse | 51/295 |
| 3,630,802 | 12/1971 | Dettring | 156/238 |
| 3,631,638 | 1/1972 | Yoshikawa | 51/295 |
| 3,641,719 | 2/1972 | Yang | 51/402 |
| 3,661,544 | 5/1972 | Whitaker | 51/295 |
| 3,689,346 | 9/1972 | Rowland | 186/245 |
| 3,770,400 | 11/1973 | Hallewell | 51/293 |
| 3,833,703 | 9/1974 | Jous | 156/231 |
| 3,859,407 | 1/1975 | Blanding et al. | 264/62 |
| 3,976,435 | 8/1976 | Klein | 29/192 |
| 3,982,358 | 9/1976 | Fukuda | 51/297 |
| 3,991,527 | 11/1976 | Maran | 51/397 |
| 4,011,358 | 3/1977 | Roelofs | 428/287 |
| 4,035,162 | 7/1977 | Brothers | 51/298 |
| 4,037,047 | 7/1977 | Haywood | 51/295 |
| 4,055,029 | 10/1977 | Kalbow | 451/527 |
| 4,106,915 | 8/1978 | Kagawa et al. | 51/296 |
| 4,111,666 | 9/1978 | Kalbow | 451/527 |
| 4,311,489 | 1/1982 | Kressner | 51/298 |
| 4,314,827 | 2/1982 | Leitheiser et al. | 51/298 |
| 4,317,660 | 3/1982 | Kramis et al . | 51/295 |
| 4,318,766 | 3/1982 | Smith | 156/330 |
| 4,331,489 | 5/1982 | Uehori et al. | 148/105 |
| 4,364,746 | 12/1982 | Bitzer et al. | 51/298 |
| 4,420,527 | 12/1983 | Conley | 428/172 |
| 4,456,500 | 6/1984 | Ibeta | 156/634 |
| 4,539,017 | 9/1985 | Augustin | 51/293 |
| 4,553,982 | 11/1985 | Korbel | 51/295 |
| 4,576,850 | 3/1986 | Martens | 428/156 |
| 4,587,291 | 5/1986 | Gardziella et al. | 524/595 |
| 4,588,258 | 5/1986 | Hoopman | 350/103 |
| 4,588,419 | 5/1986 | Caul et al. | 51/295 |
| 4,606,154 | 8/1986 | Herrmann et al. | 451/526 |
| 4,623,364 | 11/1986 | Cottringer et al. | 51/309 |
| 4,644,703 | 2/1987 | Kaczmarke et al. | 51/401 |
| 4,652,274 | 3/1987 | Boettcher et al. | 51/298 |
| 4,652,275 | 3/1987 | Bloecher et al. | 51/298 |
| 4,690,692 | 9/1987 | Hesse | 51/295 |
| 4,735,632 | 4/1988 | Oxman et al. | 51/295 |
| 4,744,802 | 5/1988 | Schwabel | 51/309 |
| 4,751,138 | 6/1988 | Tumey et al. | 428/323 |
| 4,751,797 | 6/1988 | Fujimori | 51/293 |
| 4,770,671 | 9/1988 | Monroe et al. | 51/293 |
| 4,773,920 | 9/1988 | Chasman et al. | 51/295 |
| 4,799,939 | 1/1989 | Bloecher et al. | 51/293 |
| 4,867,758 | 9/1989 | Newkirk | 51/295 |
| 4,875,259 | 10/1989 | Appeldorn | 24/576 |
| 4,880,689 | 11/1989 | Park | 156/279 |
| 4,881,951 | 11/1989 | Wood et al. | 51/309 |
| 4,881,999 | 11/1989 | Balmer | 156/231 |
| 4,903,440 | 2/1990 | Lawson et al. | 51/298 |
| 4,904,280 | 2/1990 | Cygan et al. | 51/296 |
| 4,930,266 | 6/1990 | Calhoun et al. | 51/293 |
| 4,950,696 | 8/1990 | Palazotto et al. | 522/25 |
| 4,952,612 | 8/1990 | Brown-Wensley et al. | 522/25 |
| 4,983,458 | 1/1991 | Dejaiffe | 428/402 |
| 4,985,340 | 1/1991 | Palazzotto et al. | 430/270 |
| 4,997,461 | 3/1991 | Markhoff-Matheny et al. | 51/295 |
| 5,011,508 | 4/1991 | Wald et al. | 51/293 |
| 5,011,512 | 4/1991 | Wald | 51/293 |
| 5,011,513 | 4/1991 | Zador et al. | 51/295 |
| 5,014,468 | 5/1991 | Ravipati et al. | 51/295 |
| 5,015,266 | 5/1991 | Yamamoto | 51/293 |
| 5,022,895 | 6/1991 | Wiand | 51/295 |
| 5,039,311 | 8/1991 | Bloecher | 51/295 |
| 5,061,294 | 10/1991 | Harmer et al. | 51/295 |
| 5,078,753 | 1/1992 | Broberg et al. | 51/298 |
| 5,086,086 | 2/1992 | Brown-Wensley et al. | 522/25 |
| 5,087,494 | 2/1992 | Calhoun et al. | 425/40 |
| 5,090,968 | 2/1992 | Pellow | 51/293 |
| 5,093,180 | 3/1992 | Morgan | 428/156 |
| 5,107,626 | 4/1992 | Mucci | 51/293 |
| 5,131,926 | 7/1992 | Rostoker et al. | 51/309 |
| 5,141,790 | 8/1992 | Calhoun et al. | 428/40 |
| 5,145,790 | 9/1992 | Calhoun et al. | 428/40 |
| 5,147,900 | 9/1992 | Palazzotto et al. | 522/25 |
| 5,152,917 | 10/1992 | Pieper et al. | 51/295 |
| 5,174,795 | 12/1992 | Wiand | 451/530 |
| 5,178,646 | 1/1993 | Barber, Jr. et al. | 51/298 |
| 5,178,925 | 1/1993 | Endo | 28/64 |
| 5,199,227 | 4/1993 | Ohishi | 51/395 |
| 5,201,916 | 4/1993 | Berg et al. | 51/293 |
| 5,203,884 | 4/1993 | Buchanan et al. | 51/295 |
| 5,212,910 | 5/1993 | Brievogel et al. | 451/530 |
| 5,219,462 | 6/1993 | Bruxvoort et al. | 51/293 |
| 5,236,472 | 8/1993 | Kirk et al. | 51/298 |
| 5,273,805 | 12/1993 | Calhoun et al. | 428/156 |
| 5,304,223 | 4/1994 | Pieper et al. | 51/293 |
| 5,316,812 | 5/1994 | Stout et al. | 428/64 |
| 5,318,604 | 6/1994 | Gorsuch et al. | 51/293 |
| 5,368,619 | 11/1994 | Culler | 51/308 |
| 5,378,251 | 1/1995 | Culler et al. | 51/295 |
| 5,435,816 | 7/1995 | Spurgeon et al. | 51/295 |
| 5,437,754 | 8/1995 | Calhoun | 156/231 |
| 5,453,312 | 9/1995 | Haas et al. | 428/143 |
| 5,454,844 | 10/1995 | Hibbard et al. | 51/295 |
| 5,489,235 | 2/1996 | Gagliardi et al. | 451/527 |

FOREIGN PATENT DOCUMENTS

| | | | |
|---|---|---|---|
| 2354373 | 1/1978 | France . | |
| 57-121458 | 7/1982 | Japan . | |
| 58-196974 | 11/1983 | Japan . | |
| 60-9663 | 1/1985 | Japan . | |
| 0042029 | 3/1985 | Japan | 156/231 |
| 61-244468 | 10/1986 | Japan . | |
| 62-255069 | 11/1987 | Japan . | |
| H2-83172 | 3/1990 | Japan . | |
| 4159084 | 6/1992 | Japan . | |
| 6-190737 | 7/1994 | Japan . | |
| 0749650 | 7/1980 | U.S.S.R. . | |
| 975375 | 11/1982 | U.S.S.R. . | |
| 996178 | 2/1983 | U.S.S.R. . | |
| 1316805 | 6/1987 | U.S.S.R. . | |
| 1005448 | 9/1965 | United Kingdom . | |
| 2043501 | 10/1980 | United Kingdom . | |
| 2094824 | 9/1982 | United Kingdom . | |

ABRASIVE ARTICLE HAVING PRECISE LATERAL SPACING BETWEEN ABRASIVE COMPOSITE MEMBERS

This is a continuation of U.S. Ser. No. 08/419,806, filed on Apr. 11, 1995, now abandoned which is a divisional of U.S. Ser. No. 07/820,155 filed on Jan. 13, 1992, now U.S. Pat. No. 5,437,754.

TECHNICAL FIELD OF THE INVENTION

This invention relates to abrasive articles, and more particularly, to an abrasive article having a backing that carries abrasive composite members that have a precise lateral spacing and orientation.

BACKGROUND OF THE INVENTION

Abrasive articles have long been known in the art, and have been used to abrade, finish, or polish a variety of surfaces. One type of abrasive article is a coated abrasive article, which comprises abrasive grains adhered to a backing. Paper and cloth have long been used as backing materials for coated abrasive articles. Abrasive grains may also be adhered to other types of backings, including inflexible backings.

Coarse-grade abrasive grains are incorporated into abrasive articles for rough high stock removal of material from a workpiece. On the other end of the spectrum, extremely fine abrasive grains, sometimes referred to as microabrasive grains, are incorporated into abrasive articles to achieve a close tolerance finish or polish. Coated abrasive articles containing microabrasive grains are used, for example, for magnetic head finishing; polishing or burnishing floppy disks; creating high-gloss finishes on acrylic surfaces; and providing a final finish to stainless steel or brass.

Whether the coated abrasive article utilizes microabrasive grains, coarse-grade abrasive grains, or other types of abrasive grains, it has long been recognized that the abrading surface of the article can be clogged or gummed by material worn from the workpiece. One way this problem has been addressed is by applying the abrasive grains on a backing in a dot pattern or matrix pattern. See, for example, U.S. Pat. Nos. 3,246,430 (Hurst); 794,495 (Gorton); 1,657,784 (Bergstrom); 4,317,660 (Kramis et al.). When abrasive grains are disposed in a pattern, pathways exist for abraded material to be removed.

Coated abrasive articles having abrasive grains arranged in a dot pattern have been prepared by applying an adhesive to a backing in a desired dot pattern. The backing is then flooded with abrasive grains that adhere to the dots of adhesive. Alternatively, the abrasive grains can be applied in a desired pattern to a continuous adhesive layer.

Other types of abrasive tools have been made by setting abrasive granules, such as diamonds, into a desired pattern by hand. It does not appear that hand setting of large abrasive granules, such as diamonds, has been employed in a commercially available, flexible coated abrasive article.

Abrasive grains, even when tightly graded, vary in size, and are typically of an irregular shape. However, the inability to regulate the number and position of these abrasive grains sometimes causes problems, such as uneven cutting rates, and scratches of unacceptable dimensions. These problems are accentuated in microabrasive applications.

U.S. Pat. No. 4,930,266 (Calhoun et al.) discloses an abrasive article able to produce fine finishes at high cutting rates. Calhoun et al. disclose a printing process to position individual abrasive grains or agglomerates in a regular, predetermined pattern. Thus, the article described in Calhoun et al. is able to produce a relatively predictable, consistent, and repeatable finish.

There is a need for an abrasive article that has abrasive members having a precise, lateral spacing and a consistent and desired orientation relative to the backing. The Calhoun et al. printing process places abrasive grains and agglomerates in a random orientation on the abrasive backing.

SUMMARY OF THE INVENTION

The present invention provides a method of forming an abrasive article that is able to produce a predictable, consistent, repeatable finish, with a predictable cutting rate. The present invention also provides an abrasive article that has abrasive composite members disposed on a backing in a precise pattern and orientation, with the desired lateral spacing between each abrasive composite member.

According to the method of the present invention, an embossed carrier web having a front surface and a back surface is provided. It is preferred that the embossed carrier web be flexible. The front surface has a plurality of recesses formed therein. Each recess has a recessed bottom surface portion and a side wall portion. The recesses are filled with an abrasive slurry comprising a plurality of abrasive grains dispersed in a hardenable binder precursor. The binder precursor is cured, polymerized, or otherwise hardened to form individual abrasive composite members. A backing sheet (preferably flexible) is laminated to the front surface of the embossed carrier web. The binder precursor of the abrasive slurry is hardened to form the abrasive composite members before, during, or after lamination of the backing sheet, or any combination of the foregoing, to provide the coated abrasive article. The carrier web can be removed or left in place, as desired. The resulting article comprises a plurality of precisely spaced abrasive composite members, positioned in a precise, predetermined pattern and orientation on a backing sheet. If the carrier web is left in place, it can be removed before use, or it can be made of a material that is easily eroded during use of the abrasive article.

A size coat can be coated over the surface of both the backing sheet having the abrasive composite members and the abrasive composite members themselves. Also, an adhesive layer or make coat, can be provided on the surface of the backing sheet having abrasive material to assist in firmly securing the abrasive composite members to the backing sheet. The abrasive composite members can be of any desired shape or size, including individual discrete shapes, extended or elongated rails, or other shapes.

In another aspect of this invention, the use of a backing sheet can be omitted, in which case abrasive composite members only are formed. These abrasive composite members can be applied to a backing sheet, if desired, at a time or place, or both, different from that of their formation.

The present invention also provides an abrasive article having abrasive composite members having precise lateral spacing, comprising a backing sheet having disposed thereon a plurality of precisely placed abrasive composite members comprising abrasive grains dispersed in a binder. The abrasive composite members can each be placed on the backing sheet in a substantially identical orientation relative to the backing sheet. The abrasive composite members may have a variety of shapes, such as, for example, a cylindrical shape, a cube shape, a truncated cone shape, a truncated pyramid shape, an elongated rectangular shape, or an extended rail shape. The spacing between adjacent abrasive composite members should be at least one times the minimum surface dimension of the adjacent abrasive composite members.

Placing abrasive composite members on a backing with precise and desired lateral spacing, and in a desired and consistent orientation, ensures that each abrasive composite member has a nearly identical cutting surface exposed throughout the abrading process.

"Precise," as used herein, refers to the placement of individual abrasive composite members on a backing sheet in a predetermined pattern. The lateral spacing between precisely spaced individual abrasive composite members is not necessarily the same, but the members are spaced as desired for the particular application.

"Regular," as used herein, refers to spacing the abrasive composite members in a pattern in a particular linear direction such that the distance between adjacent abrasive composite members is substantially the same. For example, a regular array of abrasive composite members may have rows and columns of abrasive composite members with each row spaced at a distance X from each adjacent row, and each column of members spaced a distance Y from each adjacent column.

"Orientation," as used herein, refers to the position of an abrasive composite member relative to the backing sheet or to another abrasive composite member. For example, one orientation for a truncated cone-shaped composite member has the base of the truncated cone placed on the backing sheet.

DETAILED DESCRIPTION

The present invention provides a method for producing abrasive articles that have abrasive composite members disposed on a backing sheet in a precise and reproducible pattern. The abrasive articles of the present invention can be used to produce a predictable, consistent, repeatable finish to a surface.

Figure 1:
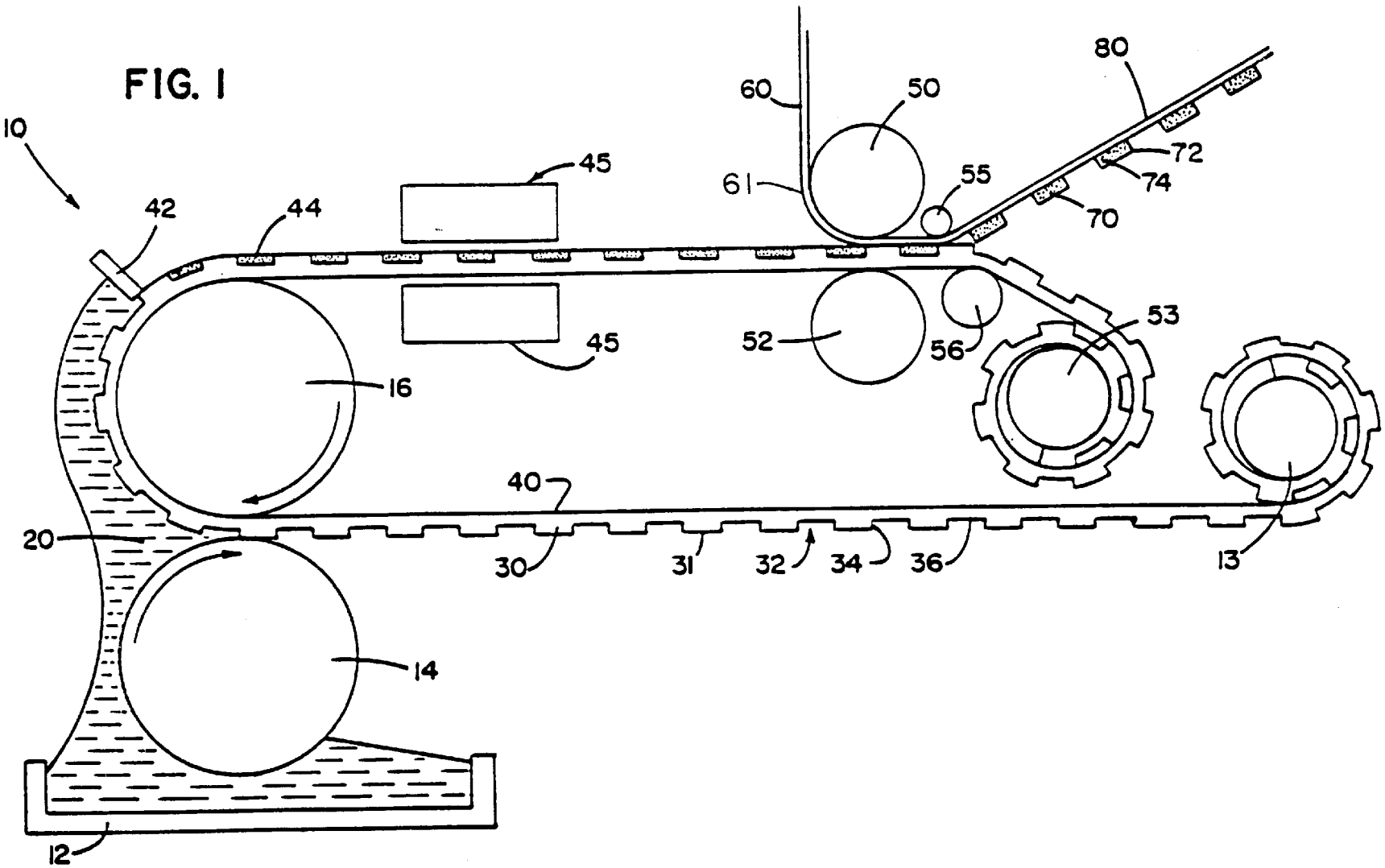
FIG. 1 is a schematic view of a coating apparatus used in the method of the present invention.

In FIGS. 1 through 6, all components are not necessarily to scale, but are scaled so as to best exemplify the components, and their relationships. Referring to FIG. 1, a schematic side elevational view of coating apparatus generally designated 10 suitable for use in the method of the present invention is shown. The apparatus 10 comprises an abrasive slurry reservoir 12, a supply roll 13, a coating roll 14, and a first carrier web roll 16. An abrasive slurry 20 comprising abrasive grains dispersed in a binder precursor is provided in the reservoir 12. An embossed carrier web 30 is unwound from the supply roll 13 and wound about the first carrier web roll 16, between the coating roll 14 and the first carrier web roll 16. The embossed carrier web 30 comprises a front surface 31 having recesses 32, which comprise side walls 34 and recessed bottom surface portions 36. The carrier web 30 also comprises a back surface 40. The back surface 40 contacts the first carrier web roll 16. The coating roll 14 is rotated in a clock-wise direction to cause the abrasive slurry 20 to fill the recesses 32 in the embossed carrier web 30. After the recesses pass the reservoir dam 42, e.g. a doctor blade, the filled recesses are designated 44. A means for solidifying the binder precursor is designated by the reference numeral 45.

The apparatus 10 further comprises a backing sheet roll 50, a second carrier web roll 52, carrier web uptake roll 53, and delamination rollers 55 and 56. A backing sheet 60 having a front surface 61 is laminated to the front surface 31 of the carrier web 30 by the backing sheet roll 50. It is preferred that at least a portion of the front surface 61 of the backing sheet 60 be in direct contact with the front surface 31, i.e., the non-recessed portion, of the embossed carrier web 30. In order to assure direct contact between the front surface 61 of the backing sheet 60 and the front surface 31 of the embossed carrier web 30, it is preferred to remove as much abrasive slurry 20 as reasonably possible from the front surface 31 of the carrier web 30. It is most preferred that there be substantially no abrasive slurry 20 on the carrier web 30 other than in the recesses 32 thereof. Direct contact between the front surface 61 of the backing sheet 60 and the front surface 31 of the carrier web 30 leads to providing areas free from abrasive material around the abrasive composite members 70. Advantages of these regions free of abrasive composite members include (1) a saving of abrasive slurry material, (2) production of a highly flexible coated abrasive article, and (3) better contact between the make coat and the abrasive composite members (i.e., better wetting of the sides of the abrasive composite members by the resin or adhesive of the make coat). The second carrier web roll 52 advances the carrier web 30 and assists in the lamination of the backing sheet 60. The backing sheet 60 preferably has a continuous adhesive make coat that will securely bond the backing sheet 60 to the abrasive composite members 70, which are formed when the binder precursor of abrasive slurry in the filled recesses 44 is hardened by solidification means 45. The backing sheet 60 may be laminated to abrasive composite members prior to complete solidification or hardening of the binder precursor contained in the filled recesses 44.

The abrasive composite members 70 comprise binder 72 and abrasive grains 74. The carrier web 30 can be either delaminated from the backing sheet 60 and the abrasive composite members 70 or allowed to remain in place as a protective cover for the abrasive composite members 70. Alternatively, the carrier web 30 can be delaminated from the backing sheet 60 at a remote location from the laminating apparatus. In yet another variation, the carrier web 30 containing hardened abrasive composite members 70 may be wound into a roll, which can be used to store abrasive composite members for subsequent attachment to a backing sheet at proximate or remote locations. The carrier web 30 is wound about the uptake roll 53 after it is delaminated from the abrasive composite members 70. Delamination rollers 55 and 56 assist in the delamination step. The finished abrasive article, which comprises the backing sheet 60 and the abrasive composite members 70, is generally designated 80. The finished abrasive article 80 can be wound on an uptake roll (not shown).

Figure 2:
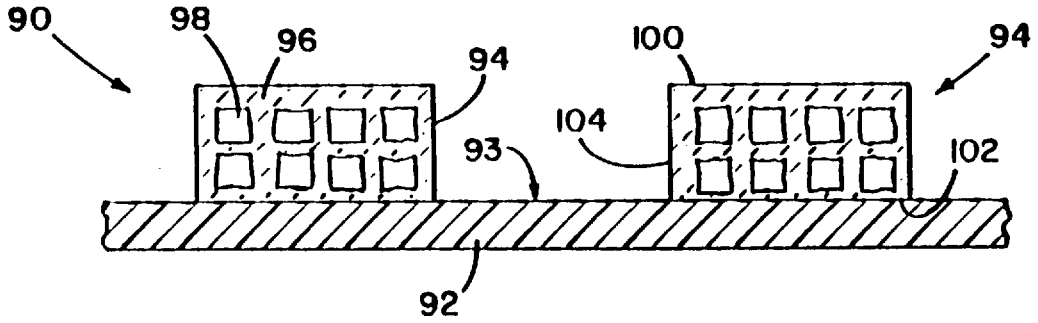
FIG. 2 is a schematic cross-sectional view of an abrasive article of the present invention.

Referring to FIG. 2, an abrasive article generally designated 90 is shown. The abrasive article 90 comprises a backing sheet 92 having a front surface 93 on which are disposed abrasive composite members 94. The abrasive composite members 94 comprise binder 96 and abrasive grains 98. Each abrasive composite member 94 has a top surface 100, a bottom surface 102, and side wall surfaces 104. Each of the abrasive composite members 94 shown in FIG. 2 is adhered to the backing sheet 92 in an identical orientation relative to the backing sheet 92 such that the bottom surface 102 is in contact with the front surface 93 of the backing sheet 92.

Figure 3:
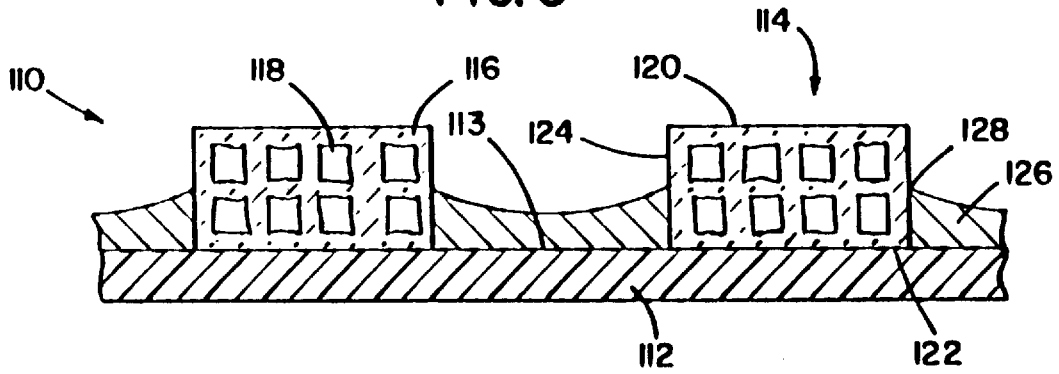
FIG. 3 is a schematic cross-sectional view of an abrasive article of the present invention.

Referring to FIG. 3, an abrasive article generally designated 110 is shown. The abrasive article 110 comprises a backing sheet 112 having a front surface 113 on which are disposed abrasive composite members 114. The abrasive composite members 114 comprise a binder 116 and abrasive grains 118. Each abrasive composite member 114 also has a top surface 120, a bottom surface 122, and side wall surfaces 124. The abrasive article 110 also comprises a make coat 126 that forms a meniscus 128 at the interface with the side walls 124 of the abrasive composite members 114. Each of the abrasive composite members 114 is adhered to the backing sheet 112 in an identical orientation relative to the backing sheet, such that the bottom surface 122 is in contact with the front surface 113 of the backing sheet 112. Each of the abrasive composite members 114 is surrounded by an area free of abrasive composite members.

Figure 4:
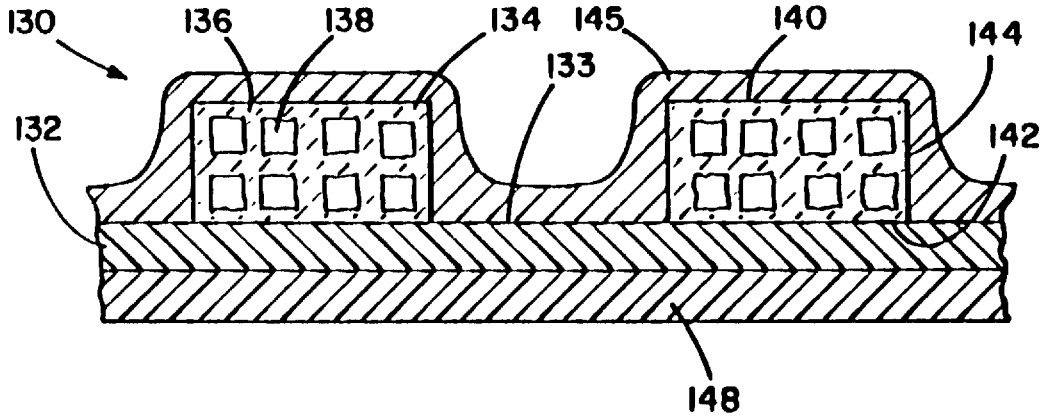
FIG. 4 is a schematic cross-sectional view of an abrasive article of the present invention.

Referring to FIG. 4, an abrasive article 130 is shown. The abrasive article 130 comprises a make coat 132 having a front surface 133 on which are disposed abrasive composite members 134. The abrasive composite members 134 comprise binder 136 and abrasive grains 138. Each abrasive composite member 134 also includes a top surface 140, a bottom surface 142, and side wall surfaces 144. The abrasive article 130 also comprises a size coat 145 applied over the front surface 133 of the make coat 132 so as to cover the side wall surfaces 144 and the top surface 140 of the abrasive composite members 134. The abrasive composite members 134 are adhered to the backing sheet 148 by the make coat 132. In practice, the abrasive composite members 134 may be partially embedded in the make coat 132. Each of the abrasive composite members 134 is adhered to the backing sheet 148 in an identical orientation relative to the backing sheet.

Figure 5A:
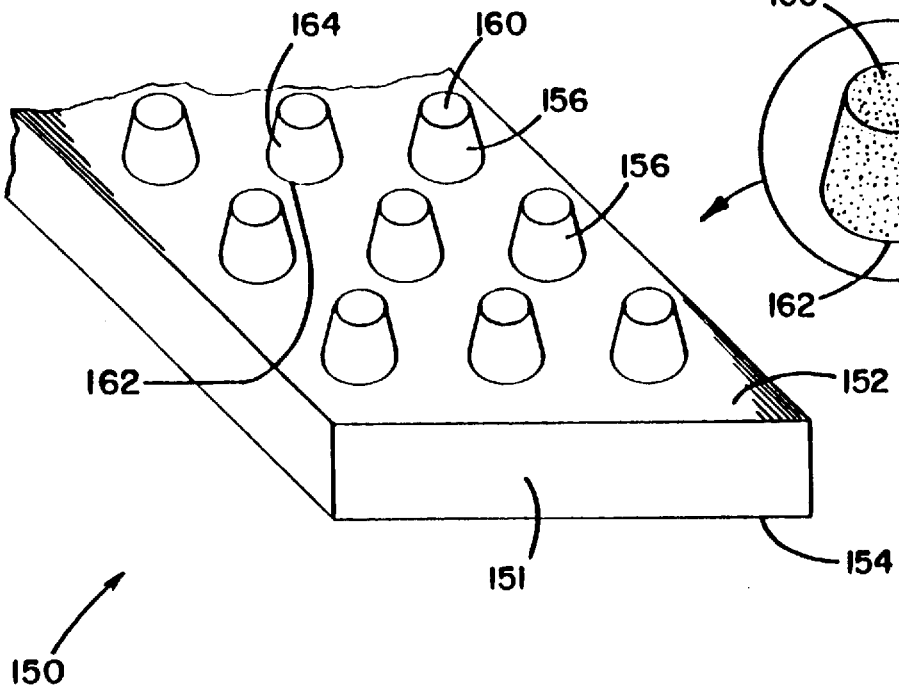
FIG. 5, which is comprised of FIG. 5A and FIG. 5B, is a schematic perspective view of an abrasive article of the present invention.
Figure 5B:
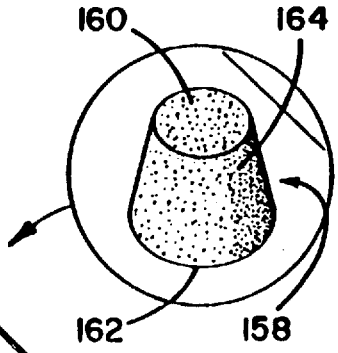

Referring to FIG. 5, a schematic perspective view of an abrasive article 150 of the present invention is shown. The abrasive article 150 comprises a backing sheet 151 having a front surface 152 and a back surface 154. Abrasive composite members 156 are spaced at regular lateral intervals on the front surface 152 of the backing sheet 151 as shown in FIG. 5A. An abrasive composite member designated by the reference numeral 158 is shown in greater detail in the circle set off to the right of abrasive article 150 as shown in FIG. 5B. The abrasive composite members 156 and 158 each include a top surface 160, a bottom surface 162, and a side wall surface 164. The method of the present invention is capable of placing each abrasive composite member 156 in an identical orientation on the front surface 152 of the backing sheet 151. In FIG. 5, the bottom surfaces 162 of the abrasive composite members 156 are each adhered to the front surface 152 of the backing sheet 151 of the abrasive article 150.

Figure 6:
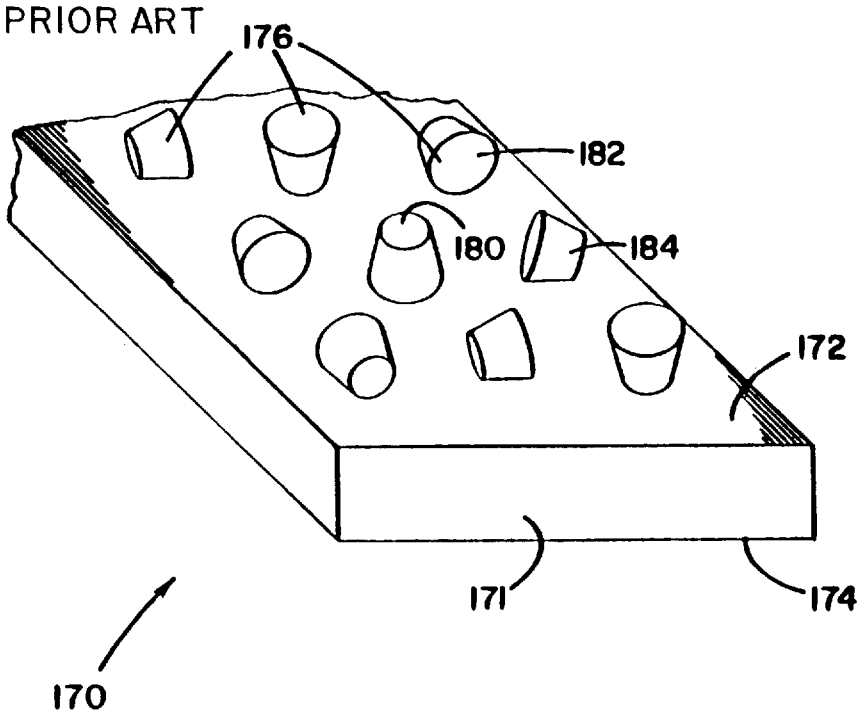
FIG. 6 PRIOR ART
FIG. 6 is a schematic perspective view of an abrasive article formed by a prior art process.

Referring to FIG. 6, a schematic perspective view of an abrasive article that is not made by the method of the present invention is shown. In FIG. 6, the abrasive article 170 includes a backing sheet 171 having a front surface 172 and a back surface 174. Abrasive composite members 176 are placed on the front surface 172 of the backing sheet 171 of the abrasive article 170. Each of the abrasive composite members 176 has a top surface 180, a bottom surface 182, and a side wall surface 184. The abrasive composite members 176 are placed on the front surface 172 in a random orientation relative to one another and relative to the front surface 172. Unlike the abrasive article 150 shown in FIG. 5, the abrasive article 170 shown in FIG. 6 does not have abrasive composite members placed on the backing sheet in a substantially identical orientation relative to one another and to the backing sheet. FIG. 6 schematically depicts an abrasive article that could result from the use of a printing process for individual abrasive particles or abrasive composite members. A printing process may be able to accomplish relatively precise lateral spacing of individual abrasive composite members, but is unable to place individual abrasive composite members on the backing in the same orientation as is shown in FIG. 5.

There are several advantages to having a precise pattern of abrasive composite members. The presence of the areas free of abrasive composite members between the individual abrasive composite members tends to reduce the amount of loading. Loading is a term used to describe the filling of space between abrasive grains or abrasive composite members with swarf (the material removed from the workpiece being abraded or sanded) and the subsequent build-up of that material. For example, in wood sanding, wood particles are lodged between abrasive grains, dramatically reducing the cutting ability of the abrasive grains. Also, the presence of the areas free of abrasive composite members tends to make the resulting abrasive article more flexible. A further advantage is that a precise pattern of the abrasive composite members can be designed to give the optimum cut for a given abrading application. A precise pattern of abrasive composite members also permits abrading to be accomplished only in those areas where abrading needs to occur. For example, in a disc application, there can be a progressively higher density of abrasive composite members as one proceeds radially from the center of the disc. Furthermore, in some applications, it is desirable that the spacing between adjacent abrasive composite members be at least one times, two times, or even five times the minimum surface dimension of the adjacent abrasive composite members. As used herein, "surface dimension" means the length of the interface formed by the intersection of an abrasive composite member and the backing sheet. For example, if the planar shape of an abrasive composite member is a rectangle having a length of 5000 micrometers and a width of 3000 micrometers, the minimum surface dimension is 3000 micrometers. Furthermore, it is within the scope of this invention that the abrasive composite members of a given abrasive article can be of different sizes or different shapes or both different sizes and different shapes. If the adjacent abrasive composite members are of unequal sizes or shapes, "minimum surface dimension" should be construed to mean the smallest surface dimension between the two adjacent abrasive composite members. This relatively open spacing can optimize the combination of the cut rate of the abrasive article, the life of the abrasive article, and the surface finish on the workpiece provided by the abrasive article. However, in order to provide a reasonable cut rate the spacing is preferably no greater than about 15 times the minimum surface dimension of the abrasive composite members.

Placing abrasive composite members on a backing with the same orientation is also advantageous. If abrasive composite members are precisely spaced, are of the same size, and are placed in the same orientation, accurate abrading of a surface can be accomplished. The three-dimensional shape of abrasive composite members having substantially vertical side walls, provides constancy of surface area of abrasive composite members, thereby maintaining a nearly constant stress on the abrasive composite members during the life of the abrasive article. However, abrasive composite members having side walls having a greater slope experience reduced stress in a predictable manner during polishing.

The abrasive composite members of the present invention provide a self-sharpening abrasive surface. As the abrasive article is used, abrasive grains are sloughed off from the abrasive composite members, and unused abrasive grains are exposed. This provides an abrasive article having a long life, having a high sustained cut rate, and capable of providing a consistent surface finish over the life of the article.

The method of the present invention provides abrasive material only at the precise locations on the backing sheet as desired and also places each abrasive composite member in a precise orientation relative to the backing sheet. These two features provide the abrasive article of the present invention the ability to produce a predictable, consistent, repeatable finish on the surface of the workpiece.

Abrasive Grain

The abrasive grain size for the abrasive composite members is typically 0.1 micrometer to 1,000 micrometers, and preferably 0.5 to 50 micrometers. It is preferred that the size distribution of the abrasive grains be tightly controlled. A narrow range of abrasive grain size typically results in an abrasive article that produces a finer finish on the workpiece being abraded. Of course, it may be desirable to include in the abrasive composite members abrasive grains of different sizes, or to have different types of abrasive composite members, with each type including abrasive grains of a particular size. For example, in the cross-section of an abrasive composite member taken perpendicular to the backing sheet, the top layer of the abrasive composite member could have an average abrasive grain size of 50 to 1000 micrometers and the layer of the abrasive composite member between the top layer and the backing sheet could have an average abrasive grain size of 0.5 to 350 micrometers. In order to achieve this distribution, a first abrasive slurry can be used to partially fill the recesses and a second abrasive slurry can be used to fill the unfilled portions of the recesses. However, care should be exercised so that the slurries do not intermix to an undesirable extent. Different binders could also be used in each layer to provide desired properties.

Examples of abrasive grains suitable for this invention include: fused alumina, heat treated alumina, ceramic aluminum oxide, silicon carbide, alumina zirconia, garnet, diamond, cubic boron nitride, diamond-like carbon, ceria, ferric oxide, silica, and mixtures thereof.

The term "abrasive grain" is also meant to encompass agglomerates. An agglomerate is a plurality of abrasive grains bonded together. Agglomerates are well known in the art and can be made by any suitable technique, such as those described in U.S. Pat. Nos. Reissue 29,808; 4,331,489; 4,652,275; and 4,799,939, incorporated herein by reference.

The abrasive composite members will typically comprise 5 to 95% by weight abrasive grain. This weight ratio will vary depending on the abrasive grain size and the type of binder employed.

Binders

The abrasive composite members of the present invention are formed from an abrasive slurry. The abrasive slurry comprises a binder precursor, which, when hardened by curing, polymerization, or otherwise, will provide a binder that disperses the abrasive grains within each abrasive composite member. The binder precursor is typically a liquid that is capable of flowing sufficiently so as to be coatable. During the manufacture of the abrasive article, the binder precursor is solidified to form the binder, which is a solid that does not flow.

The solidification can be achieved by curing, drying, or polymerization to form the binder. Solidification is typically carried out by exposing the binder precursor to an energy source, such as, for example, thermal energy sources (i.e., an oven) and radiation energy sources (i.e., electron beam, ultraviolet light, or visible light). The choice of the energy source will depend upon the chemical composition of the binder precursor. For example, phenolic resins can be solidified by a curing or polymerization mechanism when the phenolic resin is exposed to heat. Solidification can be carried out before, during, or after the carrier web is laminated to the backing sheet, or any combination of the foregoing.

Examples of binder precursors suitable for this invention include: phenolic resins, epoxy resins, urea-formaldehyde resins, melamine formaldehyde resins, acrylate resins, aminoplast resins, polyester resins, urethane resins, and mixtures thereof. The binder precursor may also contain a curing agent, catalyst, or initiator, to initiate the polymerization of the above-mentioned resins.

Phenolic resins have excellent thermal properties, are readily available, are low in cost, and are easy to handle. There are two types of phenolic resins, resol and novalac. Resol phenolic resins are activated by alkaline catalysts, and typically have a ratio of formaldehyde to phenol of greater than or equal to one, typically between 1.5:1 to 3.0:1. Alkaline catalysts suitable for these resins include sodium hydroxide, barium hydroxide, potassium hydroxide, calcium hydroxide, organic amines, and sodium carbonate. Resol phenolic resins are thermosetting resins.

A preferred binder precursor is a phenolic resin. Preferably, the phenolic resin is a rapid curing phenolic resin, such as one of the acid cured resol phenolic resins disclosed in U.S. Pat. No. 4,587,291, incorporated herein by reference.

Both resol and novalac phenolic resins, with the addition of the appropriate curing agent or initiator, are curable by heat. Examples of commercially available phenolic resins include: "VARCUM", from Occidental Chemical Corporation; "AEROFENE", from Ashland Chemical Co.; "BAKELITE", from Union Carbide; and "RESINOX", from Monsanto Company.

Epoxy resins suitable for this invention include monomeric epoxy compounds and polymeric epoxy compounds, and they may vary greatly in the nature of their backbones and substituent groups. The molecular weights of the epoxy resins typically vary from about 50 to 5,000, and preferably range from about 100 to 1000. Mixtures of various epoxy resins can be used in the articles of this invention.

Acrylate resins are also suitable for this invention. Suitable acrylate resin binder precursors can be monomeric or polymeric compounds, preferably having a molecular weight of less than about 5,000 and are preferably esters of (1) compounds containing aliphatic monohydroxy and polyhydroxy groups and (2) unsaturated carboxylic acids.

Representative examples of preferred acrylate resins suitable for this invention include methyl methacrylate, ethyl methacrylate, styrene, divinylbenzene, vinyl toluene, ethylene glycol diacrylate and methacrylate, hexanediol diacrylate, trimethylene glycol diacrylate and methacrylate, trimethylolpropane triacrylate, glycerol triacrylate, pentaerythritol triacrylate and methacrylate, pentaerythritol tetraacrylate and methacrylate, dipentaerythritol pentaacrylate, sorbitol triacrylate, sorbitor hexacrylate, bisphenol A diacrylate, and ethoxylated bisphenol A diacrylate.

The polymerization or curing of the acrylate resins can be initiated by a free radical source. The free radical source may be electron beam radiation or an appropriate curing agent or initiator.

The rate of curing of the binder precursor varies according to the thickness of the binder precursor as well as the density and character of the abrasive slurry composition.

Other Additives

The abrasive composite members may contain other materials besides the abrasive grains and the binder. These materials, referred to as additives, include coupling agents, wetting agents, foaming agents, dyes, pigments, defoamers, plasticizers, fillers, grinding aids, antistatic agents, loading resistant agents, and mixtures thereof.

It may be desirable for the abrasive composite members to contain a coupling agent. Examples of suitable coupling agents include organosilanes, zircoaluminates, and titanates. The coupling agent will generally be present at a concentration of less than 5 percent by weight, and preferably less than 1 percent by weight, of the abrasive composite member.

Carrier Web

The embossed carrier web provides a means to form and position the abrasive slurry during the making of the abrasive article of the present invention until it is solidified to form three-dimensional abrasive composite members. The carrier web can be made from materials such as, for example, polymeric film, paper, cloth, metal, glass, vulcanized fibre, or combinations and treated versions thereof. A preferred material for the carrier web is a polypropylene film. The structure of the carrier web is in the form of an elongated sheet having two ends. This is in contrast to a belt, which has no ends, i.e., is endless.

The carrier web can be embossed by any technique that provides a plurality of recesses in the surface of the carrier web. Embossing techniques suitable for the carrier web include thermal embossing, chill casting, casting, extrusion, photoresist, thermal treating, chemical etching, and laser treating.

In thermal embossing, the carrier web is pressed between two heated rolls, one of which is an embossing roll. It is preferred that the carrier web be made of a thermoplastic material, such as a polymeric film. In casting, a polymer can be cast or extruded onto an embossing roll, and then chilled to form the embossed carrier web. In photoresist embossing, certain areas of the carrier web are exposed to ultraviolet light. With a positive acting photoresist, the areas of the web that are exposed are then removed, with the unexposed areas remaining. Embossing techniques are further described in H. C. Park, "Films, Manufacture," Encyclopedia of Polymer Science and Engineering, Second Edition, Volume 7, p. 105 (1987) and J. Briston, "Plastic Films," Second Edition, Longman, Inc., N.Y. 1983, both of which are incorporated herein by reference.

By having the abrasive slurry present essentially only in the recesses, predetermined spacing of the abrasive composite members or a precise pattern of the abrasive composite members results. In the precise pattern, it is preferred that there be areas containing abrasive composite members, surrounded by areas free of abrasive composite members.

The desired height of the side walls of a recess depends on several factors, such as the pattern desired, the binder, the abrasive grain size, and the particular abrading application for which the abrasive article is intended. The height of the side wall (the depth of the recess) can vary, but typically ranges from 5 to 5000 micrometers, preferably from 10 to 1000 micrometers.

The recesses in the front surface of the carrier web can have any shape. For example, the planar shape of the recesses can be rectangular, semicircular, circular, triangular, square, hexagonal, octagonal, or other desired shape. The recesses can be linked together or unconnected. The recesses may have any shape, such as, truncated cones, truncated pyramids, cubes, cylinders, elongated troughs, chevrons, intersecting grooves, hemispheres, and combinations thereof. The recessed bottom portion typically has a maximum dimension of from 10 to 5000 micrometers and typically has a surface area of $2\times10^{-7}$ to 0.5 $cm^2$. Where the recesses are unconnected there will typically be 2 to 10,000 recesses/$cm^2$, preferably, 100 to 10,000 recesses/$cm^2$ and a corresponding number of abrasive composite members on the resultant abrasive article. Where the recesses are linked together so that they form elongated troughs, there will typically be at least 5 recesses/cm (and thus 5 abrasive composite members/cm), measured in a linear direction perpendicular to the longest dimension of the recesses or abrasive composite members.

Backing Sheet

A wide variety of flexible and rigid materials may be used for preparing the backing sheets of the abrasive article of the present invention. Materials that are suitable for forming backing sheets include polymeric films, such as polyethylene terephthalate (PET), PET having a polyethylene coating, polyethylene, polypropylene. Also, metal, ceramic, glass, cloth, vulcanized fibre, paper, non-wovens, and combinations and treated versions thereof can be used. The backing sheet is typically 10 to 1000 micrometers thick.

Make Coat and Size Coat

The abrasive composite members can optionally be secured to the backing by means of a make coat or a size coat or both. A make coat refers generally to a layer of adhesive or binder placed on the surface of the backing sheet to adhere the abrasive composite members to the surface of the backing sheet. A size coat may be of a similar material as the make coat, but is used to refer to a layer of adhesive or binder applied over the abrasive composite members and the make coat. Suitable material for preparing the make coat or size coat include such materials as phenolic resins, urea-formaldehyde resins, melamine formaldehyde resins, hyde glue, aminoplast resins, epoxy resins, acrylate resins, latexes, polyester resins, urethane resins, and mixtures thereof. Materials for the make coat or size coat can be selected from the materials described above for preparing the binder precursor. The make coat or size coat can also contain other additives, such as fillers, grinding aids, pigments, coupling agents, dyes, and wetting agents.

In the following non-limiting examples, all percentages are by weight.

EXAMPLES

The following designations are used throughout the examples:

| | |
|---|---|
| WAO | white fused alumina abrasive grain; |
| NR | novalac phenolic resin, containing 75% solids and a mixture of water, 2-ethoxy ethanol as the |

-continued

| | |
|---|---|
| | solvent; |
| EAA | ethylene acrylic acid copolymer; |
| SOL | glycol ether solvent; and |
| PET | polyethylene terephthalate film. |

The following test methods were used in the examples.

Ophthalmic Test

A pressure-sensitive adhesive was laminated to the non-abrasive side of the abrasive article to be tested. An ophthalmic test daisy (7.5 cm diameter) was cut from the abrasive article to be tested by means of a standard die. The test daisy was mounted on a 2.12 diopter spherical lapping block. The lapping block was mounted on a Coburn Rocket Model 505 lapping machine. The initial thickness of the lens, i.e., the workpiece, was measured before the lens was clamped over the lapping block. The air pressure was set at 138 KPa. The lens and lapping blocks were flooded with water. The lens was abraded, then removed, and the final thickness of the lens was measured. The amount of lens material removed was the difference between the initial and final thicknesses. The lens was made of polycarbonate. The end point of the test was three minutes.

Disc Test Procedure

The abrasive article to be tested was cut into a 10.2 cm diameter disc and secured to a foam back-up pad by means of a pressure-sensitive adhesive. The abrasive disc and back-up pad assembly were installed on a Scheifer testing machine to abrade a cellulose acetate butyrate workpiece. All of the testing was done underneath a water flow. The cut was measured every 500 revolutions or cycles of the abrasive disc.

The following comparative example was used for comparison with examples of abrasive articles of the present invention.

Comparative Example A

The abrasive article for Comparative Example A was a grade 1500 Microfine Imperial® WetorDry® paper commercially available from Minnesota Mining and Manufacturing Company, St. Paul, Minn.

Example 1

An abrasive article of the present invention was prepared as follows. An abrasive slurry was prepared by homogeneously mixing the following materials: 40 parts WAO having an average particle size of 30 micrometers, 6 parts NR, 11.7 parts isopropyl alcohol, 2 parts SOL, and 1.3 parts water. The mixed abrasive slurry was degassed at approximately 25 torr for 15 minutes. An embossed carrier web made of polypropylene (83 micrometer thick) was used. The carrier web had 26 recesses/cm arranged in a square lattice array. A square lattice array is a regular array. Each recess was in the shape of an inverted truncated cone about 0.035 mm deep. The bottom of each recess was approximately 0.05 mm in diameter and the top was about 0.08 mm in diameter. The front surface of the embossed carrier web was coated with a silicone release coating. The silicone release coating was not present in the recesses. The embossed carrier web was flooded with the abrasive slurry on both the front surface and in the recesses thereof. The abrasive slurry was removed from the front surface of the carrier web by means of a doctor blade. The resulting article was then heated for 30 minutes at a temperature of 110° C. to polymerize the phenolic resin. The binder precursor of the abrasive slurry polymerized to form an abrasive composite member in each recess.

Next, a polyethylene terephthalate (PET) film that had a surface coating of EAA (approximately 18 micrometers thick) was laminated to the front surface of the embossed carrier web, such that the EAA coating was in contact with the front surface of the embossed carrier web and the abrasive composite members. The lamination temperatures were 104° C. for the upper steel roll (numeral 50 of FIG. 1) and 104° C. for the 70 durometer silicone rubber roll (numeral 52 of FIG. 1). The force between the two rolls was 11.2 kg/linear cm. The web speed was 1.5 m/min. After being cooled to room temperature, the embossed polypropylene carrier web was removed, thereby leaving a regular array of abrasive composite members bonded to the PET film backing by the EAA coating.

Example 2

An abrasive article of the present invention was prepared as follows. An abrasive slurry was prepared by homogeneously mixing the following materials: 50 parts WAO having an average particle size of 30 micrometers, 15.2 parts NR, 5 parts SOL, 4 parts 50% solids latex ("HYCAR 1581", commercially available from BF Goodrich), 7 parts isopropyl alcohol, and 0.6 part water. The embossed carrier web was obtained from Bloomer Plastics, Bloomer, Wis., under the trade designation "TAFFETA." The embossed carrier web was made of a low density polyethylene film that had 16 square recesses/cm arranged in a square lattice array. The front surface of the embossed carrier web was coated with a silicone release coating. The raised surface portions of the embossed carrier web separating the square recesses were 125 micrometers in height and 100 micrometers in length. The embossed carrier web was flooded with the abrasive slurry so as to provide abrasive slurry on both the front surface and in the recesses thereof. A doctor blade was used to remove the abrasive slurry from the front surface of the embossed carrier web. The resulting construction was then heated for 60 minutes at a temperature of 95° C. to dry and to polymerize the phenolic resin.

Next, a PET backing sheet having a surface coating of EAA (approximately 18 micrometers thick) was laminated to the embossed carrier web, such that the EAA coating was in contact with the front surface of the embossed carrier web and the abrasive composite members. The laminating conditions were the same as in Example 1. After the assembly was cooled to room temperature, the embossed polypropylene carrier web was removed, thereby leaving a regular array of abrasive composite members bonded to the PET backing sheet by the EAA coating.

Example 3

An abrasive article of the present invention was prepared in the same manner as was used in Example 2, except that the abrasive slurry was first dried for 60 minutes at room temperature and then heated for an additional 60 minutes at a temperature of 95° C.

Example 4

An abrasive article of the present invention was prepared in the same manner as was used in Example 3, except that a different abrasive slurry and a different embossed carrier web were used. The abrasive slurry was the same type as that described in Example 1. The embossed carrier web was an embossed low density polyethylene film having 25 recesses/cm arranged in a diamond pattern. The recesses covered approximately 80% of the surface area of the carrier web. The front surface of the carrier web was coated with a silicone release coating.

Example 5

An abrasive article of the present invention was prepared in the same manner as was used in Example 4, except that a different embossed carrier web was used. The carrier web was made of PET, and a polyethylene coating that was approximately 38 micrometers thick was provided on each side of the PET. The surface of the carrier web was coated with a silicone release coating. On the front side of the carrier web, the polyethylene coating was embossed so as to contain 26 recesses/cm, in a square lattice array, and each recess was in the shape of an inverted truncated cone.

Example 6

An abrasive article of the present invention was prepared as follows. An abrasive slurry was prepared by homogeneously mixing the following materials: 25 parts A and 25 parts B "SCOTCHWELD 3520" epoxy resin commercially available from Minnesota Mining and Manufacturing Company, St. Paul, Minn., and 50 parts toluene. WAO (300 parts), having an average grain size of 50 micrometers, was added to the mixture. The embossed carrier web was made of polypropylene containing 46% by weight calcium carbonate filler. The embossed carrier web had 16 recesses/cm, arranged in a square lattice array, and each recess was in the shape of an inverted truncated cone. A silicone release coating was provided on the front surface of the embossed carrier web. The front surface of the embossed carrier web was flooded with the abrasive slurry to provide the abrasive slurry on both the front surface and in the recesses thereof. A doctor blade was used to remove the abrasive slurry the front surface of the embossed carrier web. The resulting article was cured at room temperature for three days.

Next, a PET backing sheet (50 micrometers thick) having a surface coating of EAA was laminated to the front surface of the embossed carrier web by means of a hot hand-held iron, such that the EAA coating was in contact with the front surface of the embossed carrier web and the abrasive composite members. After delamination of the carrier web, the abrasive composite members protruded from the EAA coating.

Example 7

An abrasive article of the present invention was prepared as follows. An abrasive slurry was prepared by homogeneously mixing the following materials: 67 parts WAO having an average particle size of 12 micrometers, 7 parts WAO having an average particle size of 3 micrometers, 18 parts NR, 1 part of a coupling agent ("DOW A-1120"), 5 parts SOL, 6 parts isopropyl alcohol, and 1 part water. The carrier web was made of paper that had a layer of polypropylene (125 micrometers thick) on each major surface thereof. The polypropylene on one major surface of this construction was embossed with 10 recesses/cm arranged in a square lattice array. Each recess was in the shape of an inverted truncated cone about 0.05 mm deep. The bottom of each recess was approximately 0.23 mm in diameter and the top was approximately 0.25 mm in diameter. The embossed carrier web was flooded with the abrasive slurry on both the front surface and in the recesses thereof. The slurry was removed from the front surface of the embossed carrier web by means of a doctor blade. The resulting article was heated for 30 minutes at a temperature of 65° C. to polymerize the phenolic resin. The binder precursor of the abrasive slurry polymerized to form an abrasive composite member in each recess.

Next, a PET backing sheet having a coating of EAA (approximately 18 micrometers thick) was laminated to the front surface of the embossed carrier web, such that the EAA coating was in contact with the embossed carrier web and abrasive composite members. The lamination was carried out between a steel roll (numeral 50 in FIG. 1) and a 70 durometer silicone rubber roll (numeral 52 in FIG. 1). Each roll was at a temperature of about 115° C. The force between the two rolls was 11.2 kg/linear cm. The speed of the web was 1.5 m/min. After being cooled to room temperature, the embossed carrier web was removed, thereby leaving a regular array of abrasive composite members bonded to the PET backing sheet by the EAA coating. The bond was further enhanced by heating the abrasive article for 15 minutes at a temperature of 110° C.

The abrasive article of Example 7 was tested in accordance with the Ophthalmic Test procedure. The amount of lens removed was 0.58 mm. The Ra value was 0.23 micrometer. In comparison, the 3M Imperial® Beaded Microabrasive-12 micron coated abrasive, commercially available from Minnesota Mining and Manufacturing Company, St. Paul, Minn., had a lens removal of 0.54 mm and a Ra value of 0.23 micrometer.

Example 8

An abrasive article of the present invention was prepared in the same manner as was used in Example 7, except that the embossed carrier web containing the polymerized composite abrasive members was laminated to a cotton twill cloth, designated TX309, available from the Texwipe Co., Saddle River, N.J. The lamination was carried out by placing a film of EAA (approximately 50 micrometers thick) between the cloth and the carrier web containing the abrasive composite members. This assembly was then passed between the laminating rolls under the conditions described in Example 7. After being cooled to room temperature, the embossed polypropylene carrier web was removed, thereby leaving a regular array of abrasive composite members bonded to the cloth by the EAA film.

Example 9

An abrasive article of the present invention was prepared in the same manner as was used in Example 7, except that a different embossed carrier web was used. The embossed carrier web was made of a polypropylene film containing approximately 20 percent of a calcium carbonate filler and less than 0.5 percent of a fluorocarbon urethane internal release agent.

The abrasive article was tested according to the Disc Test Procedure. The results are set forth in Table I.

TABLE I

Disc Test Procedure Results

| | Cut in grams | |
|---|---|---|
| No. of cycles | Example 9 | Control Example A |
| 500 | 0.15 | 0.31 |
| 1000 | 0.19 | 0.16 |
| 1500 | 0.20 | 0.12 |
| 2000 | 0.19 | 0.07 |

TABLE I-continued

| Disc Test Procedure Results | | |
|---|---|---|
| | Cut in grams | |
| No. of cycles | Example 9 | Control Example A |
| 2500 | 0.19 | 0.05 |
| 3000 | 0.19 | The abrasive disc |
| 3500 | 0.19 | was used up; test |
| 4000 | 0.16 | was stopped. |
| 4500 | 0.15 | |

Example 10

An abrasive article of the present invention was prepared in the same manner as was used in Example 9, except that the WAO in the abrasive slurry had an average grain size of 40 micrometers and the PET backing sheet was laminated to the abrasive article by means of "3M 3789 JET-MELT" hot-melt adhesive instead of EAA. The roll temperatures during lamination were both approximately 140° C. After being cooled to room temperature, the embossed polypropylene film was removed, thereby leaving a regular array of abrasive composite members bonded to the PET by the hot-melt adhesive.

Example 11

An abrasive article of the present invention was prepared in the same manner as was used in Example 10, except that the embossed carrier web containing the polymerized composite abrasive members was laminated to a waterproof paper backing. After being cooled to room temperature, the embossed polypropylene carrier web was removed, thereby leaving a regular array of composite abrasive members bonded to the paper by the hot-melt adhesive.

Example 12

An abrasive article of the present invention was prepared as follows. An abrasive slurry was prepared by homogeneously mixing the following materials: 64 parts heat-treated fused aluminum oxide having an average particle size of 180 micrometers, 24 parts NR, 8 parts SOL, 9 parts isopropyl alcohol, and 1 part water. The embossed carrier web for this sample was a male/female embossed polyvinylchloride sheet, designated "POLYTHERM" UG 45/60201, available from Lake Crescent, Inc., Fairlawn, N.J. The embossed carrier web had 6 recesses/cm arranged in a square lattice array. Each recess was about 0.35 mm deep, 1.3 mm in diameter at the top, and each recess had a rounded bottom. The front surface of the embossed carrier web was flooded with the abrasive slurry such that the abrasive slurry was present on the front surface and in the recesses thereof. The abrasive slurry was removed from the front surface of the carrier web by means of a doctor blade. The resulting article was then heated for three minutes at a temperature of 95° C.

Next, a PET film that had a surface coating of EAA (approximately 75 micrometers thick) was laminated to the front surface of the carrier web and the abrasive composite members. The EAA coating was in contact with the front surface of the carrier web. The laminating conditions were the same as those described in Example 7. After being cooled to room temperature, the embossed carrier web was removed, thereby leaving a regular array of abrasive composite members bonded to the PET film by the EAA coating.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising:

a backing sheet having adhered thereto a plurality of unconnected precisely placed abrasive composite members, each comprising abrasive grains dispersed in a binder, each of said abrasive composite members surrounded by regions free of abrasive composite members; and said abrasive composite members each positioned on the backing sheet such that there is a precise spacing between the abrasive composite members and said abrasive composite members having a substantially identical orientation relative to the backing sheet, the spacing measured at the backing between adjacent abrasive composite members being at least two times the minimum surface dimension of the adjacent abrasive composite members, and the average area spacing of said abrasive composite members being from about 100 composites/$cm^2$ to about 10,000 composites/$cm^2$.

2. The abrasive article of claim 1 wherein the abrasive composite members are adhered directly to the backing sheet.

3. The abrasive article of claim 1 further comprising a make coat layer on the backing sheet to adhere the abrasive composite members to the backing sheet.

4. The abrasive article of claim 1 wherein said abrasive composite members have a cylindrical shape having a top surface, bottom surface, and a side wall surface, each of said abrasive composite members having the bottom surface thereof adhered to said backing sheet.

5. The abrasive article of claim 1 wherein said abrasive composite members have a cubical shape having a top surface, a bottom surface, and four side wall surfaces, each of said abrasive composite members having the bottom surface thereof adhered to said backing sheet.

6. The abrasive article of claim 1 wherein said abrasive composite members have a truncated conical shape having a top surface, a bottom surface, and a side wall surface, said top surface having a lesser surface area than said bottom surface, and each of said abrasive composite members having the bottom surface thereof adhered to said backing sheet.

7. The abrasive article of claim 1 wherein said abrasive composite members have a truncated pyramidal shape having a top surface, a bottom surface, and at least three side wall surfaces, said top surface having a lesser surface area than said bottom surface, and each of said abrasive composite members having the bottom surface thereof adhered to said backing sheet.

8. The abrasive article of claim 1 further comprising a make coat layer on the backing sheet to adhere said abrasive composite members to said backing sheet.

9. The abrasive article of claim 8 wherein the make coat comprises a polymeric material selected from the group consisting of phenolic resins, acrylate resins, epoxy resins, polyester resins, urea-formaldehyde resins, and melamine-formaldehyde resins.

10. The abrasive article of claim 1 further comprising a size coat provided over said backing sheet and said abrasive composite members.

11. The abrasive article of claim 1 wherein said abrasive composite members have a height of 5 to 5000 micrometers.

12. The abrasive article of claim 1 wherein said abrasive composite members have a generally planar top surface and a generally planar bottom surface, said bottom surface adhered to said backing sheet and said top surface having a lesser surface area than said bottom surface.

13. The abrasive article of claim 12 wherein said top surface of each of said abrasive composite members has a surface area from about $2\times10^{-7}$ $cm^2$ to about 0.01 $cm^2$.

14. The abrasive article of claim 1 wherein said abrasive composite members are placed in a regular array of regularly spaced rows and columns.

15. The abrasive article of claim 1 wherein each abrasive composite member contains 5 to 95 percent by weight abrasive grains.

16. The abrasive article of claim 1 wherein said backing sheet has a thickness of 10 to 1000 micrometers.

17. The abrasive article of claim 1 wherein said abrasive composite members comprise more than one layer.

18. The abrasive article of claim 1 wherein said abrasive composite members comprise more than one layer and wherein said layers have different size abrasive grains.

19. The abrasive article of claim 1 wherein said abrasive composite members comprise more than one layer and wherein said layers have different binders.

20. The abrasive article of claim 1 wherein the spacing between adjacent abrasive composite members is at least three times the minimum surface dimension of the abrasive composite members.

21. The abrasive article of claim 1 further comprising a removable or erodable carrier web covering the abrasive composite members.

22. The abrasive article of claim 1 wherein the abrasive composites have unequal sizes, unequal shapes, or a combination of unequal sizes and unequal shapes.

* * * * *